US008943859B2

(12) United States Patent
Sung et al.

(10) Patent No.: US 8,943,859 B2
(45) Date of Patent: Feb. 3, 2015

(54) DETERGENT CASE AND WASHING MACHINE HAVING THE SAME

(75) Inventors: Jong Hun Sung, Suwon-si (KR); Kwon Hee Kim, Seoul (KR); Woong Cho, Seoul (KR); Jung Hoon Kim, Seoul (KR); Chang Hee Jo, Seoul (KR); Yul Kwon, Seoul (KR); Kang Hyun Lee, Jeonju-si (KR); Jae Woong Han, Seoul (KR); Hun Gun Koh, Seoul (KR); Doo Ri Kim, Seoul (KR); Hyo Chan Kwon, Seoul (KR)

(73) Assignees: Samsung Electronics Co., Ltd., Suwon-Si (KR); Korea University Research and Business Foundation, Seoul (KR)

( * ) Notice: Subject to any disclaimer, the term of this patent is extended or adjusted under 35 U.S.C. 154(b) by 839 days.

(21) Appl. No.: 13/173,529

(22) Filed: Jun. 30, 2011

(65) Prior Publication Data

US 2012/0174632 A1 Jul. 12, 2012

(30) Foreign Application Priority Data

Jan. 12, 2011 (KR) ..... 10-2011-0003015

(51) Int. Cl.
*D06F 39/02* (2006.01)

(52) U.S. Cl.
CPC ..... *D06F 39/022* (2013.01)
USPC ..... 68/17 R; 68/12.18; 68/207

(58) Field of Classification Search
CPC ..... D06F 39/02; D06F 39/022; D06F 39/088; D06F 39/028; F16K 24/044; F16K 1/306; F16K 1/34; F16K 25/00; F16K 31/22; F16K 31/24
USPC ..... 68/17 R, 207, 12.18; 134/93; 222/173, 222/386, 132, 145.1, 145.5, 651
See application file for complete search history.

(56) References Cited

U.S. PATENT DOCUMENTS 2,991,911 A * 7/1961 Spain ..... 222/67
5,473,914 A * 12/1995 Pyo et al. ..... 68/17 R (Continued)

FOREIGN PATENT DOCUMENTS

DE 15 85 577 11/1971
DE 36 08 619 9/1987
DE 37 12 323 10/1988

(Continued)

OTHER PUBLICATIONS

English Machine Translation of Description of FR2699572 Al (Galdeano et al. Dec. 1992).*

(Continued)

*Primary Examiner* — Michael Barr
*Assistant Examiner* — Irina Graf
(74) *Attorney, Agent, or Firm* — Staas & Halsey LLP

(57) ABSTRACT

A detergent case which includes a liquid detergent accommodation space, a siphon pipe protruded upwardly from a bottom surface of the liquid detergent accommodation space, and a siphon cap surrounding the siphon pipe. The detergent case also includes a remaining water discharge hole formed on a bottom surface of the liquid detergent accommodation space, and an opening and closing unit to open and close the remaining water discharge hole due to buoyancy of a liquid accommodated within the liquid detergent accommodation space.

21 Claims, 13 Drawing Sheets

(56) References Cited

U.S. PATENT DOCUMENTS

2009/0100880 A1* 4/2009 Hill ..... 68/17 R
2009/0178719 A1* 7/2009 Matsuo ..... 137/409

FOREIGN PATENT DOCUMENTS

EP 2325376 A1 * 5/2011 ..... D06F 39/02
FR 2699572 A1 * 6/1994 ..... E03D 9/02

OTHER PUBLICATIONS

European Search Report issued May 27, 2013 in corresponding European Application No. 11 17 3442.

* cited by examiner

DETERGENT CASE AND WASHING MACHINE HAVING THE SAME

CROSS-REFERENCE TO RELATED APPLICATIONS

This application claims the benefit of Korean Patent Application No. 2011-0003015, filed on Jan. 12, 2011 in the Korean Intellectual Property Office, the disclosure of which is incorporated herein by reference.

BACKGROUND

1. Field

Embodiments of the present disclosure relate to a detergent case to supply a liquid detergent using siphonage, which has a structure to discharge water remaining in the detergent case after supply of the liquid detergent, and a washing machine having the same.

2. Description of the Related Art

In general, a washing machine is an apparatus which agitates laundry placed within a drum, wash water and a detergent using drive power of a motor to wash the laundry due to friction between the laundry and the wash water.

A detergent supply device of the washing machine enables the detergent to be uniformly mixed with wash water during a process of supplying the wash water to the inside of a tub so as to supply the wash water containing the detergent to the inside of the tub.

Further, a detergent case is provided with a liquid detergent accommodation space to accommodate a liquid detergent in order to use the liquid detergent, and supplies the liquid detergent diluted with the wash water to the inside of the tub using siphonage. Such a detergent case includes a siphon pipe and a siphon cap assembled with the siphon pipe so as to generate siphonage.

However, since such siphonage occurs only when a designated level is reached, the wash water or the liquid detergent remains in the detergent case at a water level below the designated level, thus generating poor sanitation and lowering product reliability.

Further, steam generated during a process of boiling or drying the laundry may be gathered in the detergent case.

SUMMARY

Therefore, it is an aspect of the present disclosure to provide a detergent case having a remaining water discharge structure so as to prevent water from remaining within the detergent case and a washing machine having the same.

Additional aspects of the disclosure will be set forth in part in the description which follows and, in part, will be apparent from the description, or may be learned by practice of the disclosure.

In accordance with one aspect of the present disclosure, a detergent case includes a liquid detergent accommodation space, a siphon pipe protruded upwardly from a bottom surface of the liquid detergent accommodation space so as to discharge a liquid, accommodated within the liquid detergent accommodation space, to the outside if the liquid reaches a designated height, a siphon cap surrounding the siphon pipe so as to form a siphon channel, a remaining water discharge hole formed on the bottom surface of the liquid detergent accommodation space so as to discharge the remainder of the liquid, not discharged by the siphon pipe, to the outside and an opening and closing unit moving upwardly and downwardly due to buoyancy of the liquid accommodated within the liquid detergent accommodation space to open and close the remaining water discharge hole.

The opening and closing unit may include a buoyancy member floated due to buoyancy and a sealing member connected to the lower end of the buoyancy member to open and close the remaining water discharge hole.

The bottom surface of the liquid detergent accommodation space may be inclined such that the remaining water discharge hole is formed at the lowermost position.

The buoyancy member may include a head part having an upwardly concave shape, an extension part extended from the lower end of the head part and passing through the remaining water discharge hole, and a plurality of legs separated from each other so as to prevent the head part from being closely adhered to the bottom surface of the liquid detergent accommodation space, and the sealing member may be connected to the lower end of the extension part.

A cavity may be formed within the head part.

A groove into which the sealing member is inserted may be formed on the outer circumferential surface of the extension part.

The buoyancy member may be formed of polypropylene.

The sealing member may include a connection part closely adhered to the extension part and a sealing part inclinedly extended upwardly from the edge of the connection part to seal the remaining water discharge hole.

The sealing part of the sealing member may be formed of rubber.

The detergent case may further include a guide part protruded downwardly around the remaining water discharge hole so as to restrict horizontal movement of the opening and closing unit to maximally transmit force in the vertical direction.

In accordance with another aspect of the present disclosure, a detergent case includes at least one liquid detergent accommodation space, a first discharge hole formed in one of the at least one liquid detergent accommodation space to generate siphonage so as to discharge a liquid accommodated therewithin if the liquid reaches a designated height, and a second discharge hole passing through a bottom surface of the liquid detergent accommodation space provided with the first discharge hole so as to discharge the remainder of the liquid not discharged through the first discharge hole, and separated from the first discharge hole.

In accordance with a further aspect of the present disclosure, in a washing machine having a detergent supply device installed at one side of a main body, the detergent supply device includes a detergent case having a liquid detergent accommodation space, wherein the detergent case includes a siphon pipe to generate siphonage so as to discharge a liquid if the liquid reaches a designated height, a remaining water discharge hole to discharge the remainder of the liquid not discharged by the siphon pipe, and an opening and closing unit moving upwardly and downwardly due to buoyancy of the liquid accommodated within the liquid detergent accommodation space to open and close the remaining water discharge hole.

The opening and closing unit may include a buoyancy member floated due to buoyancy and a sealing member connected to the lower end of the buoyancy member to open and close the remaining water discharge hole.

The remaining water discharge hole may be formed at the lowermost position of the liquid detergent accommodation space.

The buoyancy member may include a head part having an upwardly concave shape, an extension part extended from the lower end of the head part and vertically passing through the remaining water discharge hole, and a plurality of legs separated from each other so as to prevent the head part from being closely adhered to the bottom surface of the liquid detergent accommodation space, and the sealing member may be connected to the lower end of the extension part.

The sealing member may include a connection part closely adhered to the extension part and a sealing part inclinedly extended upwardly from the edge of the connection part to seal the remaining water discharge hole.

The detergent case may further include a guide part protruded downwardly around the remaining water discharge hole so as to restrict horizontal movement of the opening and closing unit to maximally transmit force in the vertical direction.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
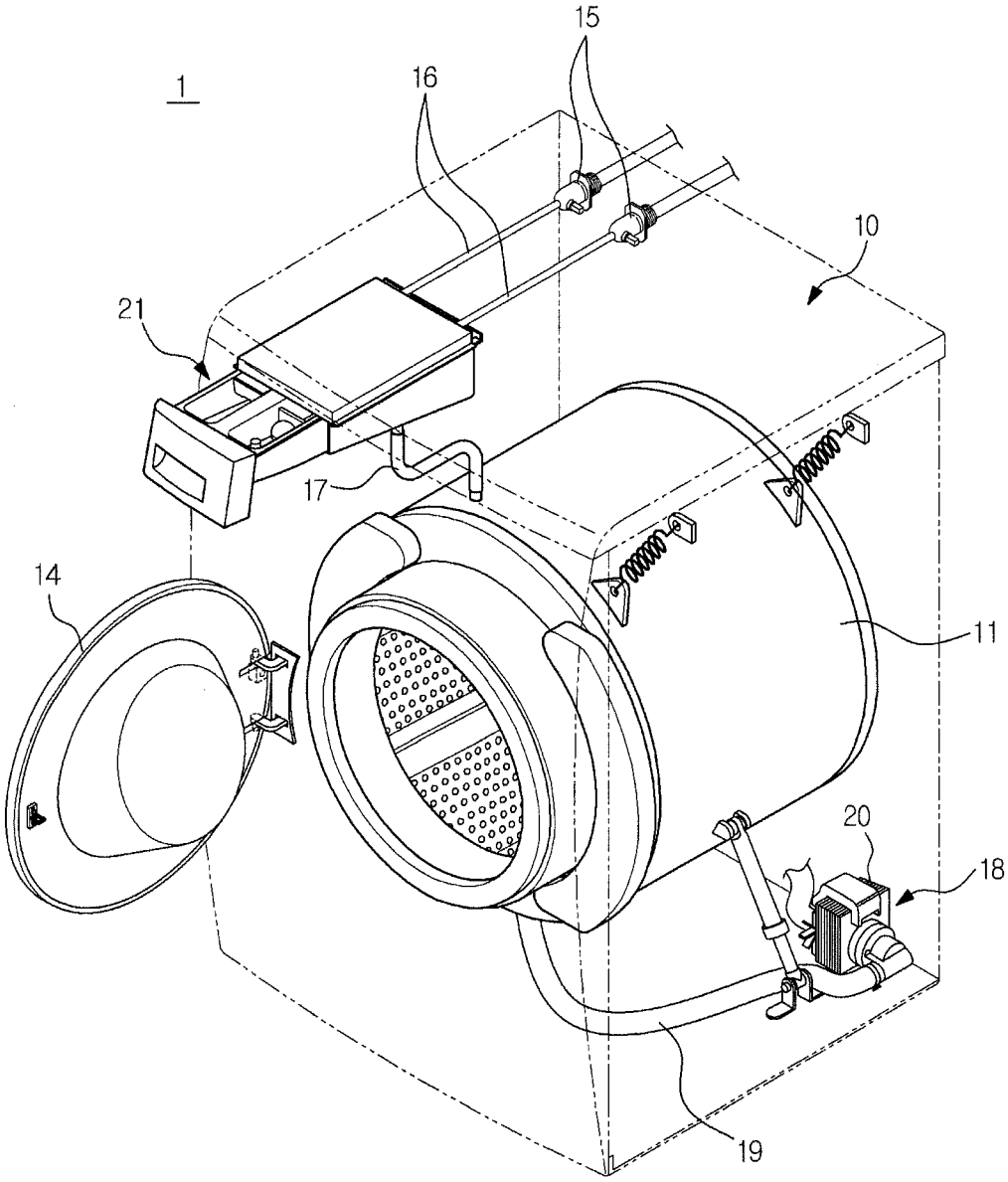
FIG. 1 is a perspective view illustrating a washing machine in accordance with one embodiment of the present disclosure.

Reference will now be made in detail to the embodiments of the present disclosure, examples of which are illustrated in the accompanying drawings, wherein like reference numerals refer to like elements throughout.

Figure 2:
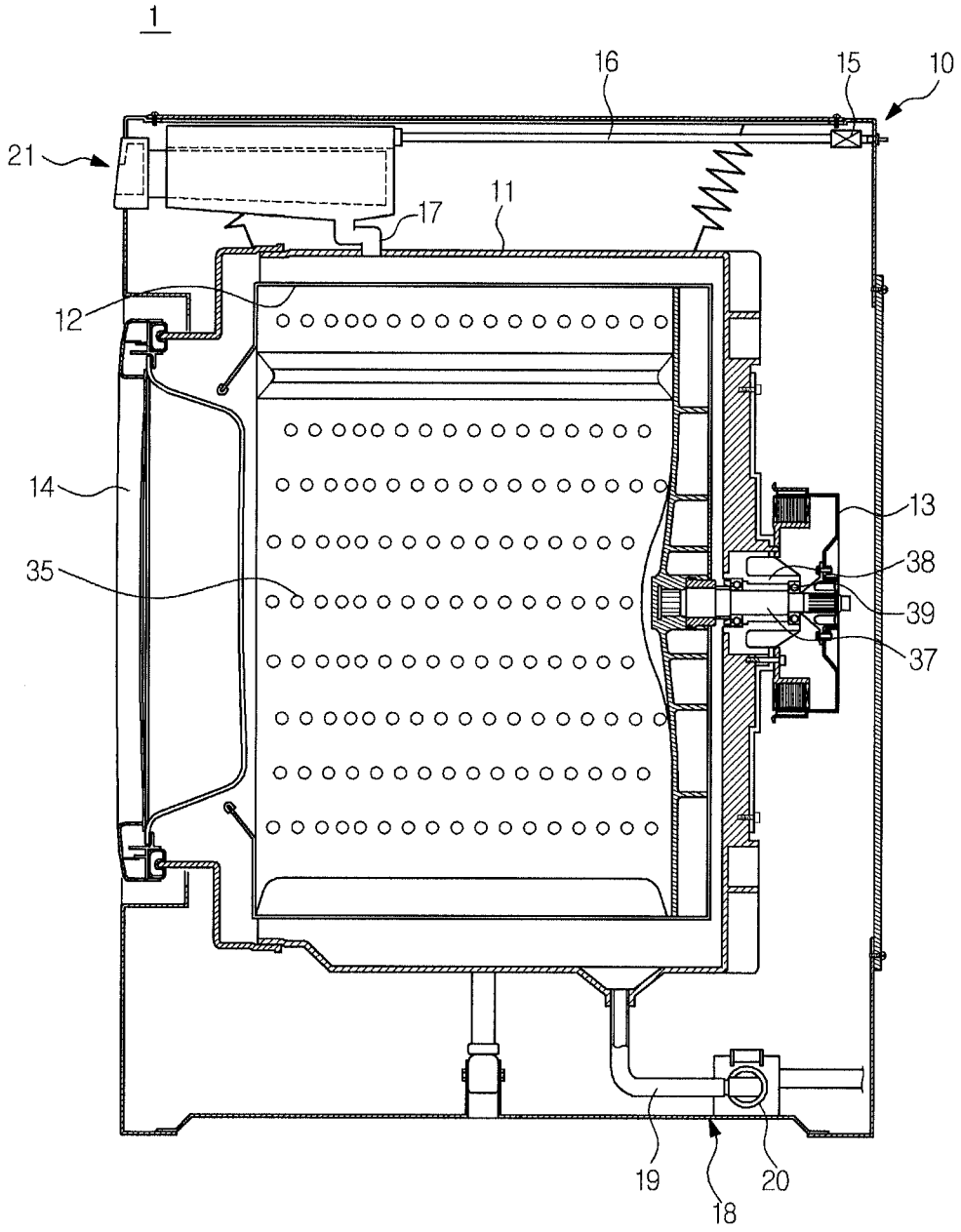
FIG. 2 is a cross-sectional view of the washing machine of FIG. 1.

FIG. 1 is a perspective view illustrating a washing machine in accordance with one embodiment of the present disclosure and FIG. 2 is a cross-sectional view of the washing machine of FIG. 1.

As shown in FIGS. 1 and 2, a washing machine 1 in accordance with this embodiment includes a main body 10 forming the external appearance of the washing machine 1, a tub 11 installed within the main body 10 to store wash water, a cylindrical drum 12 rotatably installed within the tub 11 and provided with a plurality of dehydration holes 35 formed through a side wall thereof, and a drive motor 13 rotating the drum 12 to perform washing, wringing and spin-drying cycles.

Each of the tub 11 and the drum 12 is provided with an opening provided in front of the main body 10 so that laundry may be put into or taken out of the main body 10 therethrough, a door 14 to open and close the openings of the tub 11 and the drum 12 is hinged to the front surface of the main body 10.

Water supply hoses 16 to receive the wash water supplied from the outside of the main body 10 are installed, and water supply valves 15 to control water supply are installed on the water supply hoses 16. Further, a detergent supply device 21 is installed on the front surface of the main body 10.

The wash water introduced from the outside of the main body 10 is supplied to the detergent supply device 21 through the water supply hoses 16, is mixed with a detergent within the detergent supply device 21, and is then supplied to the inside of the tub 11 through a connection pipe 17.

The drive motor 13 to rotate the drum 12 is installed on the outer surface of the rear portion of the tub 11 and a drive shaft 37 to transmit rotary force of the drive motor 13 to the drum 12 is installed between the drum 12 and the drive motor 13. Further, a bearing housing 38 to rotatably support the drive shaft 37 is installed on a rear plate of the tub 11 and a bearing 39 is installed between the bearing housing 38 and the drive shaft 37.

A drain device 18 to forcibly discharge the wash water within the tub 11 to the outside of the main body 10 after completion of washing of the laundry is provided under the tub 11. The drain device 18 includes a drain hose 19 and a drain pump 20.

Figure 3:
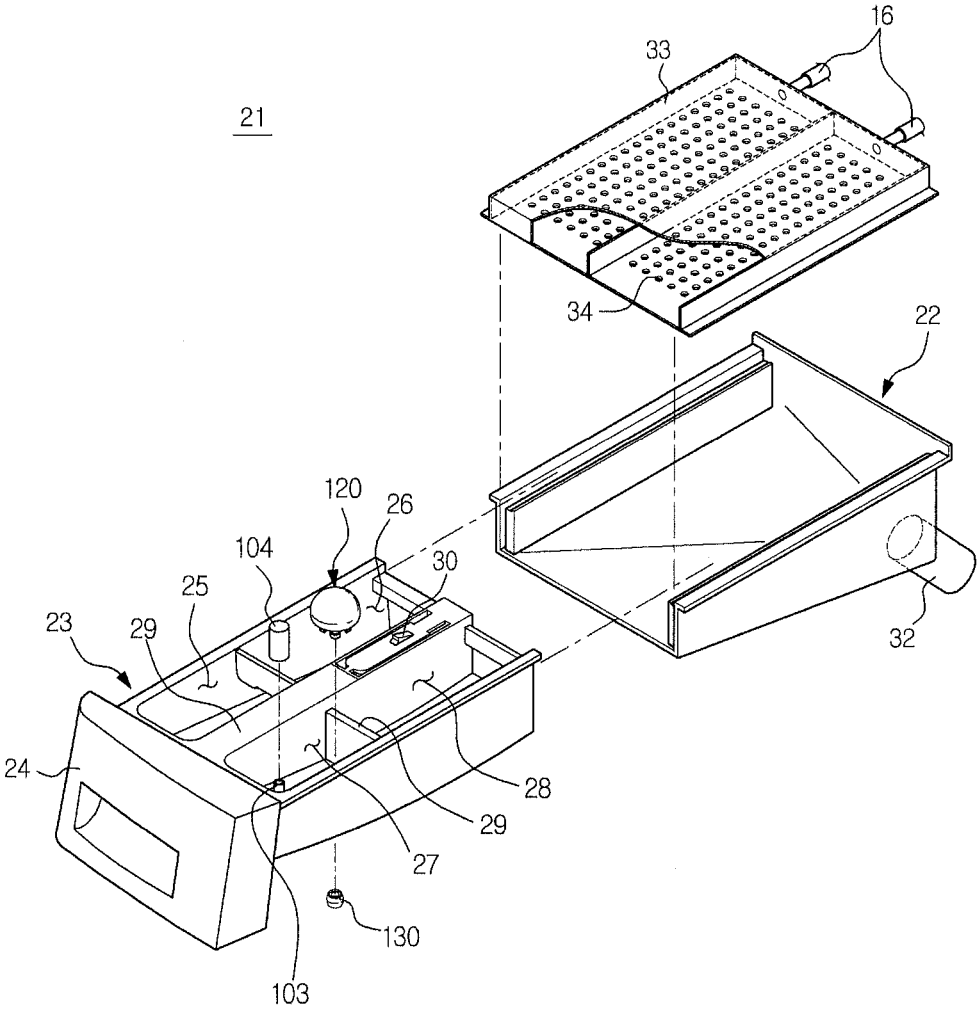
FIG. 3 is an exploded perspective view illustrating a detergent supply device of the washing machine of FIG. 1.
Figure 4:
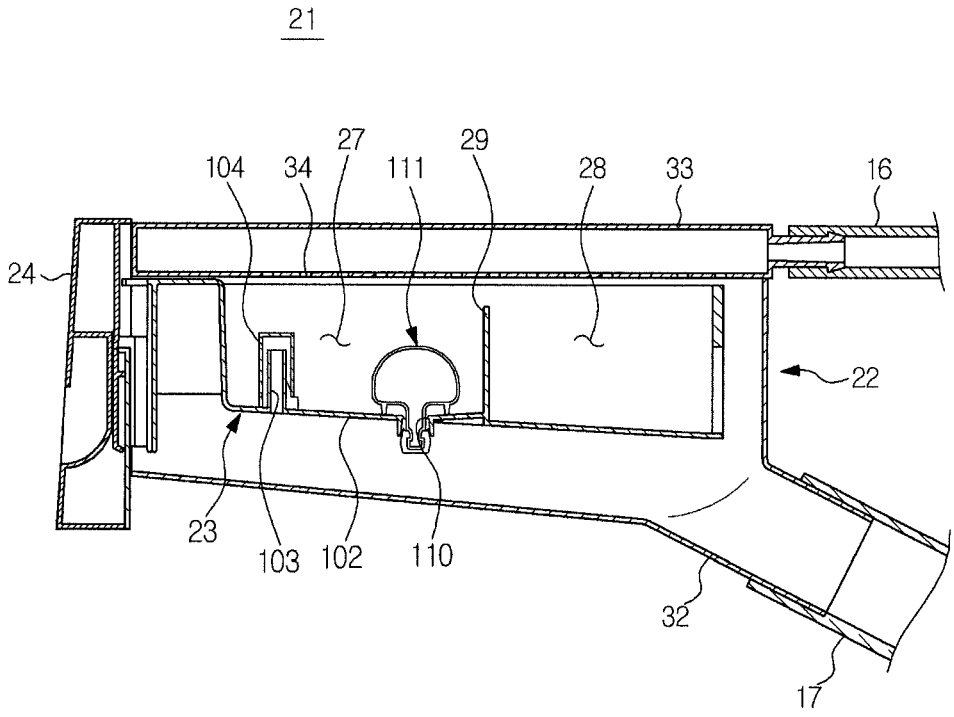
FIG. 4 is a cross-sectional view of the detergent supply device of the washing machine of FIG. 1.
Figure 5:
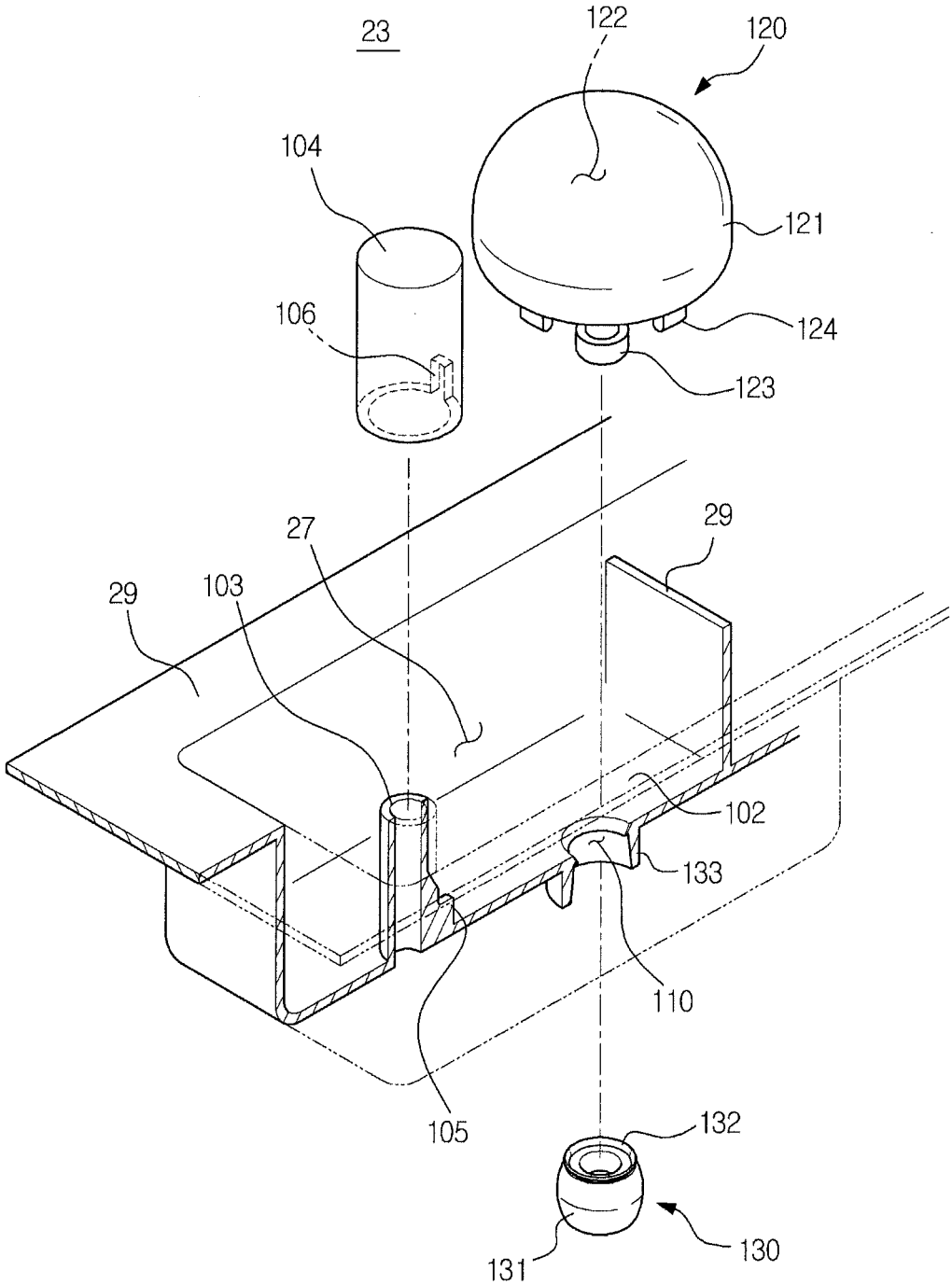
FIG. 5 is a perspective view illustrating a detergent case in accordance with one embodiment of the present disclosure.

FIG. 3 is an exploded perspective view illustrating the detergent supply device of the washing machine of FIG. 1, FIG. 4 is a cross-sectional view of the detergent supply device of the washing machine of FIG. 1 and FIG. 5 is a perspective view illustrating a detergent case in accordance with one embodiment of the present disclosure.

With reference to FIGS. 3 to 5, the detergent supply device 21 includes a box-shaped housing 22 provided with opened front and upper surfaces and a detergent case 23 detachably connected to the inside of the housing 22 through the opened front surface of the housing 22.

The detergent supply device 21 is disposed at the front surface of the upper region of the main body 10 so that the detergent case 23 may be drawn into and out of the main body 10 from the outside of the main body 10.

The housing 22 is provided with an inner space to accommodate the detergent case 23, a water supply case 33 is connected to the opened upper surface of the housing 22 and the water supply hoses 16 are connected to the water supply case 33. The water supply case 33 is provided with a plurality of through holes 34 to supply wash water to the inside of the detergent case 23.

An outlet 32 to discharge the detergent and the wash water is formed at the rear portion of the housing 22 so that the wash water introduced through the through holes 34 of the water supply case 33 together with the detergent accommodated within the detergent case 23 is supplied to the connection pipe 17.

The bottom of the housing 22 is inclined so that the detergent and the wash water flow toward the outlet 32, and the detergent and the wash water are mixed and then supplied to the inside of the tub 11 through the connection pipe 17 connected to the outlet 32.

A handle 24 enabling a user to draw the detergent case 23 into and out of the housing 22 is provided on the front surface of the detergent case 23.

The inside of the detergent case 23 is divided by a diaphragm 29. A latch part 30 to connect the detergent case 23 to the housing 22 is provided on the upper surface of the diaphragm 29.

The inside of the detergent case 23 is divided into a plurality of detergent accommodation spaces 25, 26, 27 and 28 by the diaphragm 29 so that a main washing detergent, a preliminary washing detergent, a fabric rinse and a bleaching agent are divisionally accommodated within the detergent accommodation spaces 25, 26, 27 and 28. Although this embodiment of the present disclosure illustrates four detergent accommodation spaces, the number of the detergent accommodation spaces may be increased or decreased, as needed.

The bottoms of the powdered detergent accommodation spaces 25 and 26 are inclined toward the outlet 32. The side surfaces of the powdered detergent accommodation spaces 25 and 26 close to the outlet 32 are opened so as to accommodate a powdered detergent.

A siphon pipe 103 and a siphon cap 104 are formed on the liquid detergent accommodation spaces 27 and 28 so as to discharge a liquid detergent.

Further, a remaining water discharge hole 110 to discharge water remaining after discharge of the liquid detergent through the siphon pipe 103 and an opening and closing unit 111 to open and close the remaining water discharge hole 110 are provided. The opening and closing unit 111 is formed by connecting a buoyancy member 120 and a sealing member 130, and a detailed description thereof will be given later.

It will be apparent that the respective detergent accommodation spaces 25, 26, 27 and 28 may have configurations and purposes differing from those in this embodiment.

Figure 6:
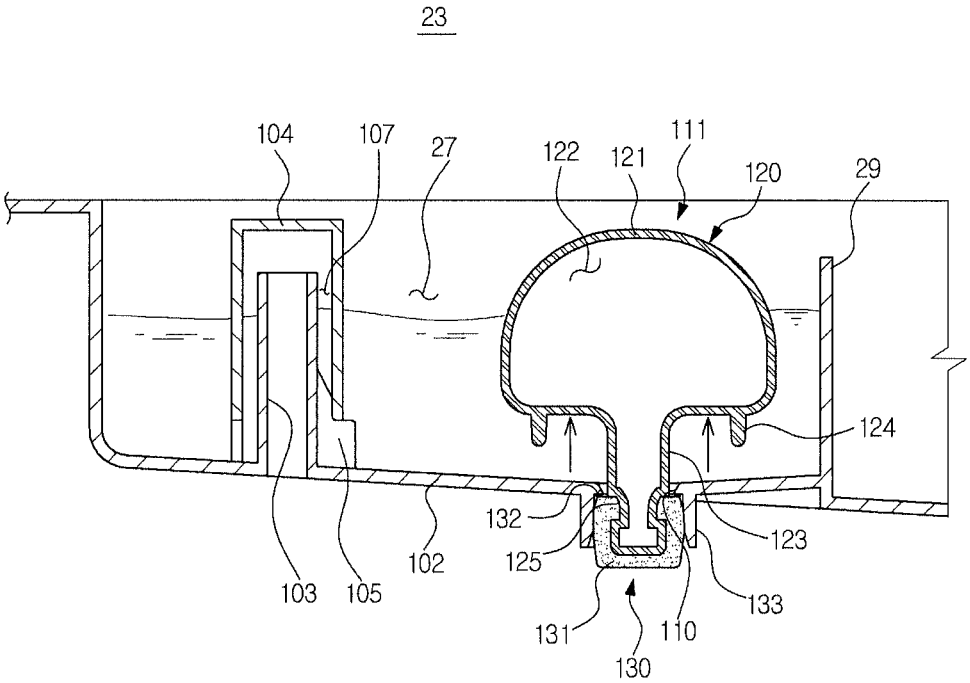
FIG. 6 is a cross-sectional view of the detergent case of FIG. 5 in a state in which a remaining water discharge hole is closed.
Figure 7:
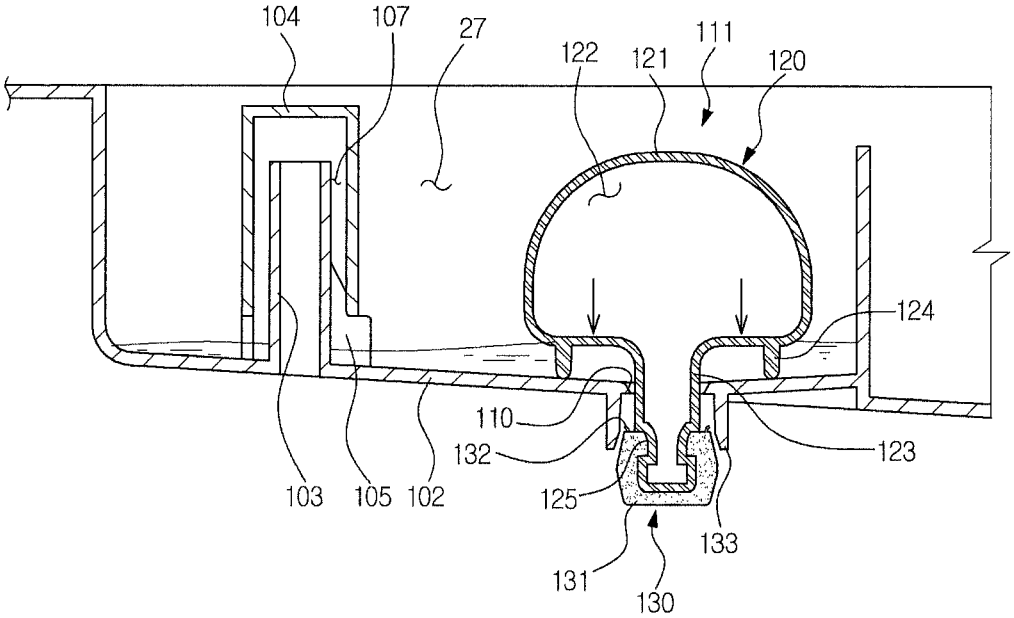
FIG. 7 is a cross-sectional view of the detergent case of FIG. 5 in a state in which the remaining water discharge hole is opened.

FIG. 6 is a cross-sectional view of the detergent case of FIG. 5 in a state in which the remaining water discharge hole is closed and FIG. 7 is a cross-sectional view of the detergent case of FIG. 5 in a state in which the remaining water discharge hole is opened.

Hereinafter, with reference to FIGS. 3 to 7, a configuration of the detergent case 23 in accordance with this embodiment will be described.

The detergent case 23 includes the siphon pipe 103 and the siphon cap 104 to generate siphonage, the remaining water discharge hole 110 to discharge water remaining in the liquid detergent accommodation space 27, and the opening and closing unit 111 to open and close the remaining water discharge hole 110.

The opening and closing unit 111 to open and close the remaining water discharge hole 110 may be omitted, and the detergent case 23 may include only the siphon pipe 103 to generate siphonage and the remaining water discharge hole 110 passing through a bottom surface 102 of the liquid detergent accommodation space 27 to discharge remaining water.

In this case, the size of the remaining water discharge hole 110 is adjusted, thereby preventing the liquid detergent having a relatively high viscosity from being discharged and allowing the wash water having a relatively low viscosity to be discharged.

The opening and closing unit 111 includes the buoyancy member 120 floated due to buoyancy and the sealing member 130 to seal the remaining water discharge hole 110.

A liquid detergent or a fabric rinse may be put into the liquid detergent accommodation space 27 by a user, and thus be mixed with wash water introduced from the outside.

Such a liquid detergent is moved to the outside of the detergent case 23 by siphonage.

The siphon pipe 103 is protruded upwardly from one position of the bottom surface 102 of the body 101 and serves to communicate the inside and the outside of the detergent case 23 with each other.

The siphon cap 104 has a slightly greater diameter than that of the siphon pipe 103 so as to surround the siphon pipe 103, and a siphon groove 106 is formed on the siphon cap 104 so that a siphon guide 105 provided at one side of the outer surface of the siphon pipe 103 is inserted into the siphon groove 106.

Therefore, when the siphon guide 105 is inserted into the siphon groove 106, the siphon cap 104 is assembled with the siphon pipe 103 and thus a siphon channel 107 is formed between the siphon pipe 103 and the siphon cap 104.

When the liquid detergent accommodation space 27 is filled with a designated amount of wash water, siphonage is generated and thus the wash water accommodated within the liquid detergent accommodation space 27 flows to the outside of the detergent case 23 through the siphon channel 107.

In the detergent case 23 in accordance with this embodiment of the present disclosure, the remaining water discharge hole 110 is formed on the bottom surface 102 of the liquid detergent accommodation space 27 so as to discharge remaining water. Since siphonage is generated only when the liquid detergent accommodation space 27 is filled with wash water of more than a designated amount, if the wash water accommodated within the liquid detergent accommodation space 27 is discharged to the outside through the siphon channel 107 and thus an amount of the wash water accommodated within the liquid detergent accommodation space 27 is small, siphonage is stopped. Therefore, the wash water may remain within the detergent case 23.

In order to flow the wash water remaining within the detergent case 23 toward the remaining water discharge hole 110, the bottom surface 102 of the liquid detergent accommodation space 27 is inclined such that the remaining water discharge hole 110 is located at the lowermost position.

The opening and closing unit 111 includes the buoyancy member 120 floated due to buoyancy and the sealing member 130 connected to the lower end of the buoyancy member 120 to seal the remaining water discharge hole 110. The opening and closing unit 111 moves upwardly and downwardly by means of buoyancy of the wash water accommodated within the liquid detergent accommodation space 27, thus opening and closing the remaining water discharge hole 110.

The buoyancy member 120 includes a head part 121 and an extension part 123 extended from the lower end of the head part 121.

The head part 121 has a hemispheric shape so that the wash water is not gathered within the upper end of the head part 121. However, the head part 121 may have other concave shapes to prevent the wash water from being gathering, such as a triangular pyramidal shape or a bullet shape.

Further, the head part 121 may have a relatively large size so that the buoyancy member 120 easily floats on the wash water, and a cavity may be formed within the inside 122 of the head part 121.

The extension part 123 is extended downwardly from the lower end of the heat part 121 and passes through the remaining water discharge hole 110. That is, a diameter of the extension part 123 is slightly smaller than a diameter of the remaining water discharge hole 110.

The sealing member 130 is connected to the lower end of the extension part 123. The sealing member 130 moves upwardly and downwardly under the remaining water discharge hole 110, thus opening and closing the remaining water discharge hole 110.

Such a buoyancy member 120 may be made of polypropylene so as to be effectively floated on the wash water.

Further, the buoyancy member 120 includes a plurality of legs 124 extended from the lower end of the head part 121 so as to prevent the head part 121 from contacting the bottom surface 102 of the liquid detergent accommodation space 27.

The plurality of legs 124 prevents obstruction to upward movement of the buoyancy member 120 caused by contact of the buoyancy member 120 with the bottom surface 102 due to viscosity of the liquid detergent.

The plurality of legs 124 may be separated from each other so as not to prevent the wash water from passing through a space under the head part 121.

The sealing member 130 includes a connection part 131 closely adhered to the extension part 123 of the buoyancy member 120 and a sealing part 132 inclinedly extended upwardly from the edge of the upper end of the connection part 131 to seal the remaining water discharge hole 110.

The connection part 131 is partially inserted into a groove 125 formed on the outer circumferential surface of the extension part 123 so as to firmly connect the sealing member 130 and the buoyancy member 120.

The sealing part 132 of the sealing member 130 may be made of rubber having elasticity.

When the sealing member 130 moves upwardly, the sealing part 132 of the sealing member 130 is pressurized by the bottom surface 102, and the pressurized sealing part 132 is slightly tensioned.

At this time, the sealing part 132 is firmly adhered to the bottom surface 102 by elastic restoring force of the sealing part 132, thereby maintaining air tightness of the remaining water discharge hole 110.

In order to restrict horizontal movement of the opening and closing unit 111 and thus to maximally transmit force in the vertical direction, a guide part 133 protruded downwardly is formed around the remaining water discharge hole 110. The guide part 133 is slightly wider than the sealing member 130 so as to surround the sealing member 130.

Figure 11:
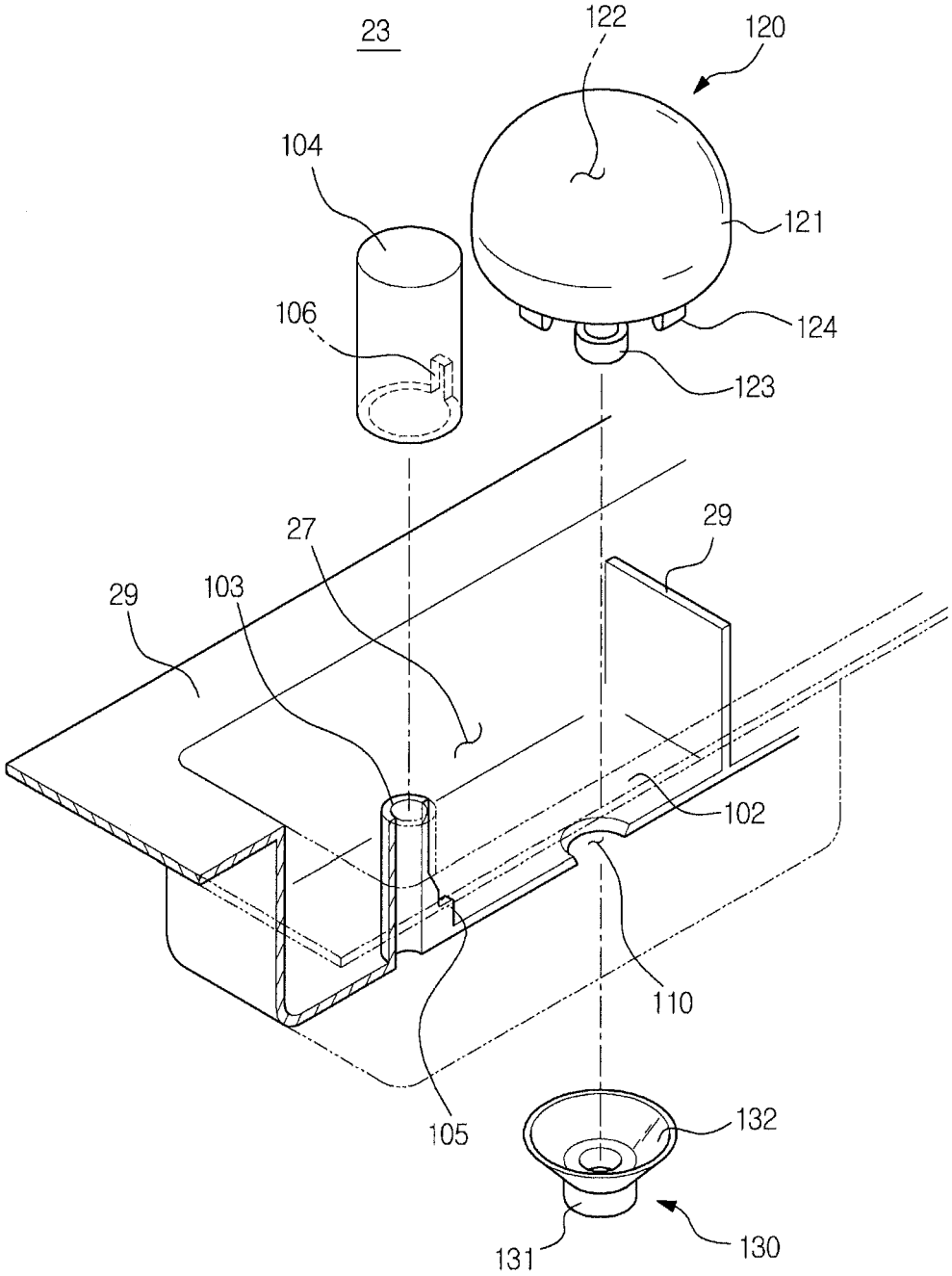
FIG. 11 is a perspective view illustrating a detergent case in accordance with another embodiment of the present disclosure.
Figure 12:
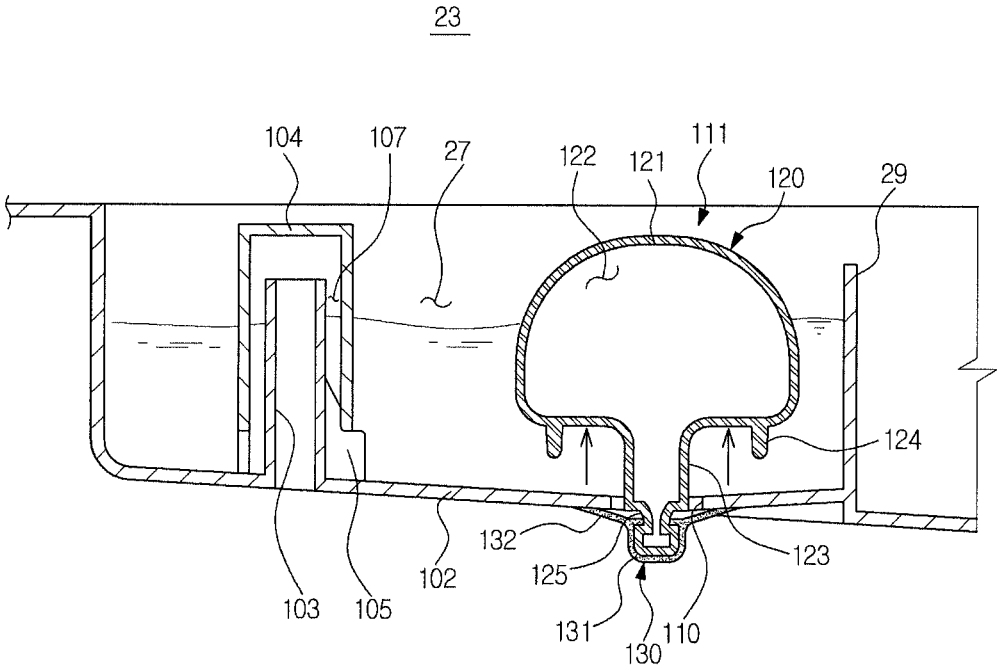
FIG. 12 is a cross-sectional view of the detergent case of FIG. 11 in a state in which a remaining water discharge hole is closed.
Figure 13:
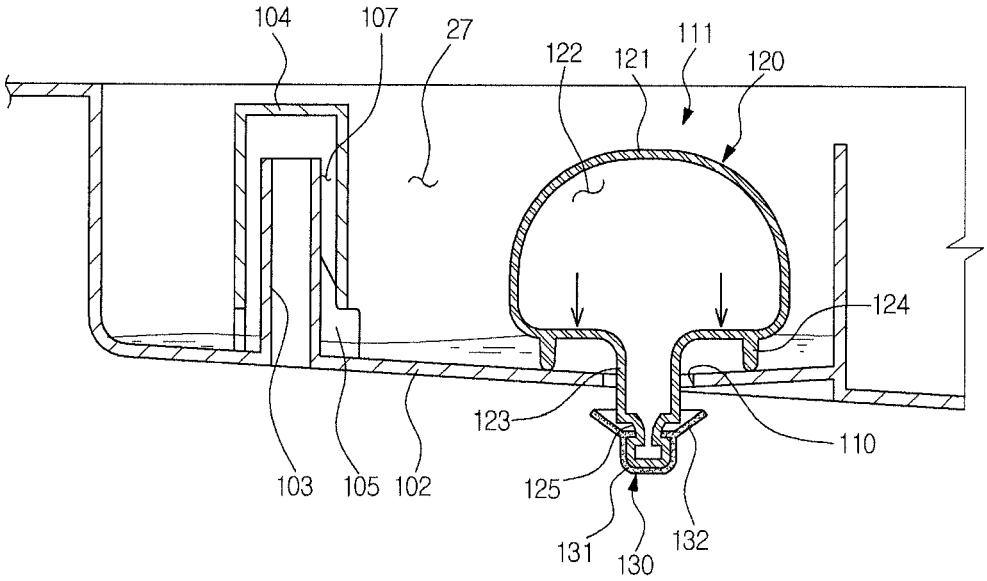
FIG. 13 is a cross-sectional view of the detergent case of FIG. 11 in a state in which the remaining water discharge hole is opened.

FIG. 11 is a perspective view illustrating a detergent case in accordance with another embodiment of the present disclosure, FIG. 12 is a cross-sectional view of the detergent case of FIG. 11 in a state in which a remaining water discharge hole is closed, and FIG. 13 is a cross-sectional view of the detergent case of FIG. 11 in a state in which the remaining water discharge hole is opened.

Here, shapes of a connection part 131 and a sealing part 132 of a sealing member 130 of the detergent case 23 in accordance with this embodiment may be variously modified as long as air tightness of a remaining water discharge hole 110 is maintained.

As shown in FIGS. 11 to 13, the sealing part 132 of the sealing member 130 is extended so as to increase a contact area with a buoyancy member 120 to improve adhesion to the buoyancy member 120. Here, the guide part illustrated in the former embodiment may be omitted. If the guide part is present, the guide part guides vertical movement of an opening and closing unit 111 so as to facilitate movement of the opening and closing unit 111, but a size of the sealing part 132 needs to be smaller than a size of the guide part so as to prevent the sealing part 132 from being interfered by the guide part.

Figure 8:
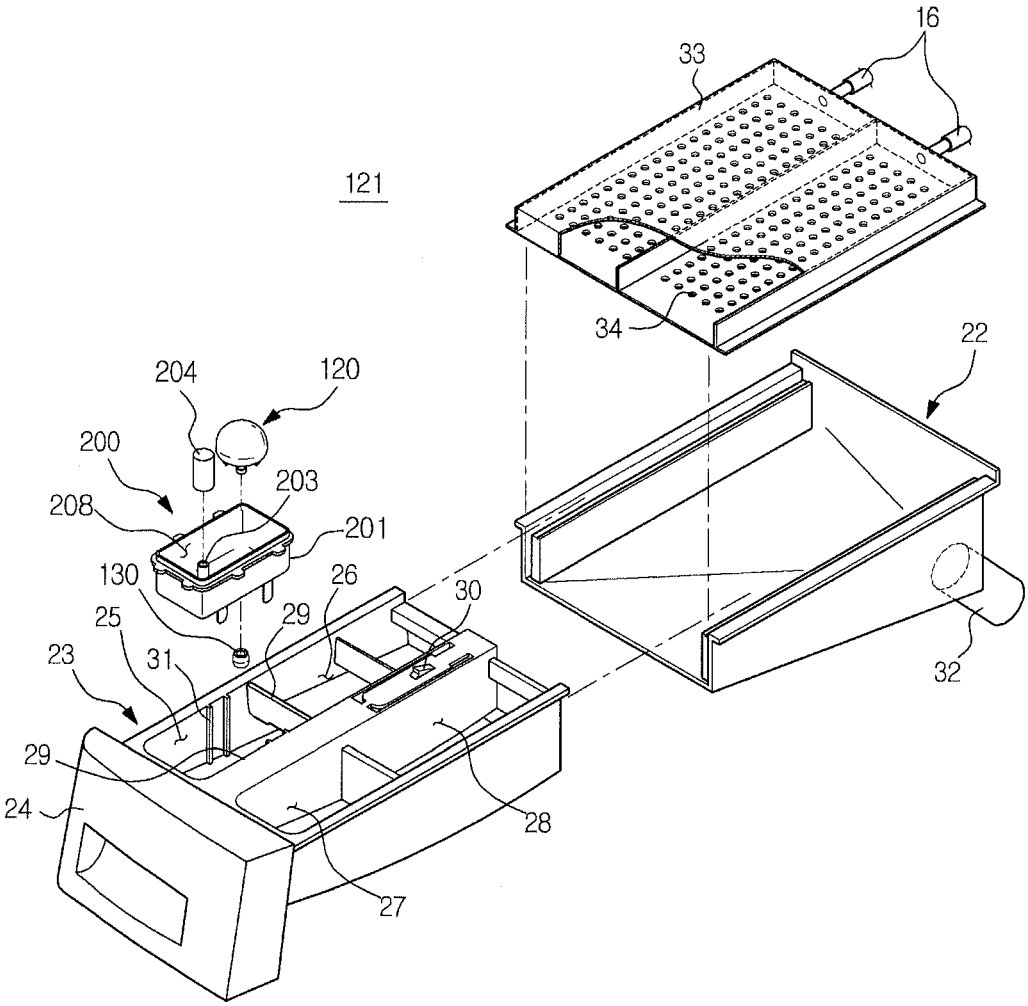
FIG. 8 is an exploded perspective view illustrating a detergent supply device of a washing machine in accordance with another embodiment of the present disclosure.
Figure 9:
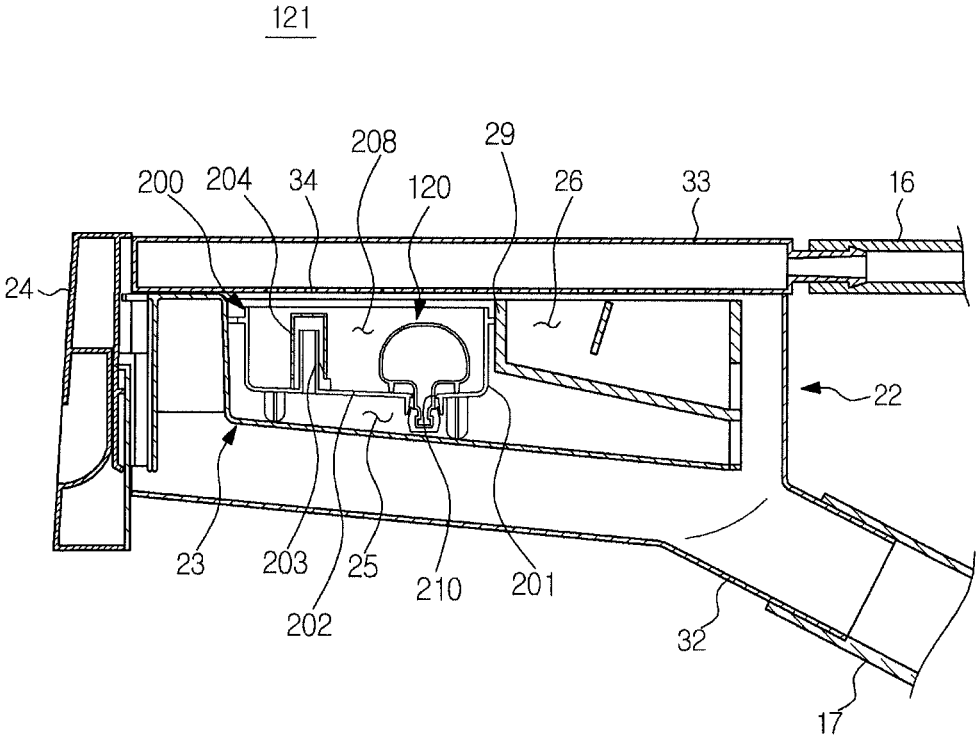
FIG. 9 is a cross-sectional view of the detergent supply device of the washing machine of FIG. 8.
Figure 10:
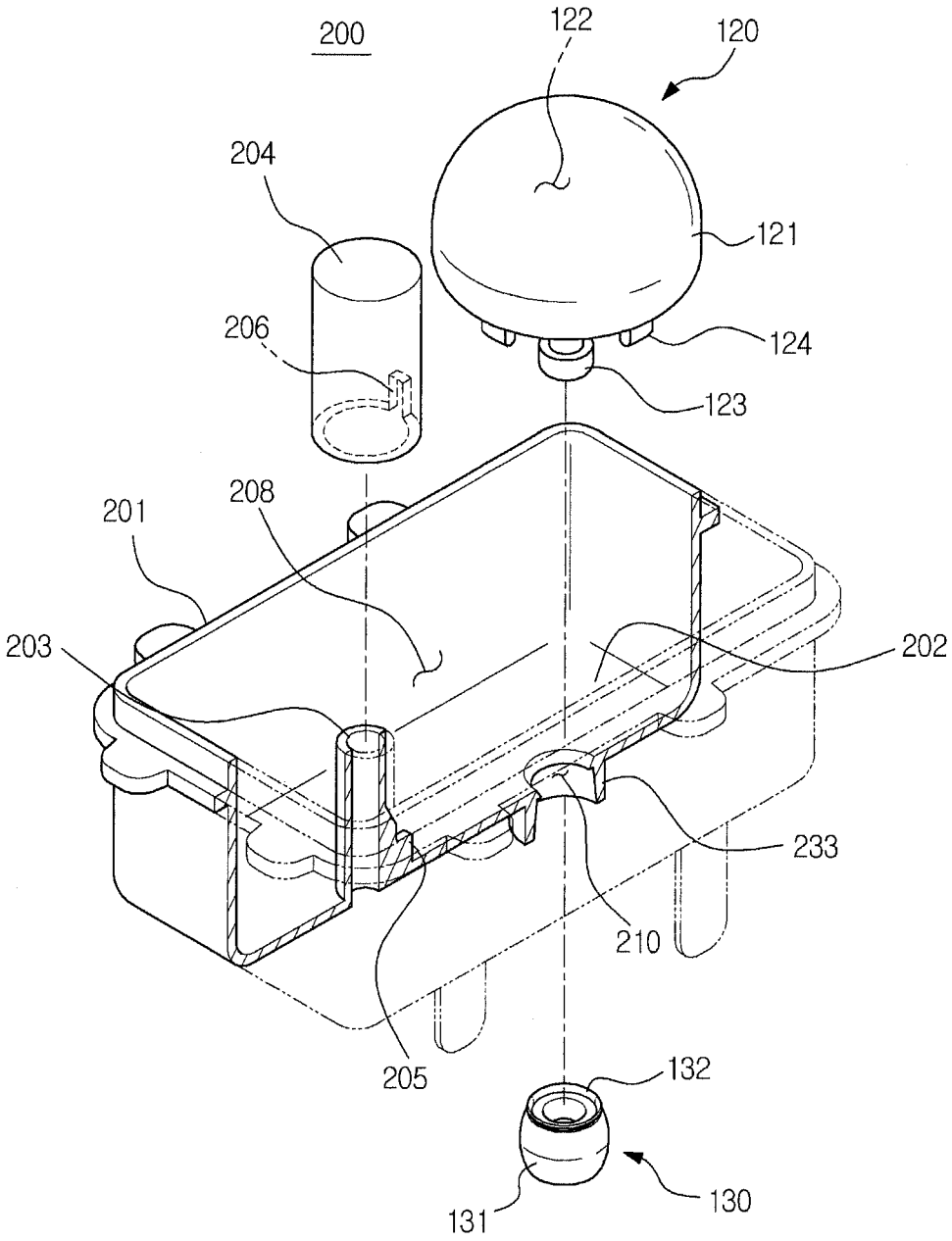
FIG. 10 is a perspective view illustrating a liquid detergent case of the washing machine of FIG. 8.

FIG. 8 is an exploded perspective view illustrating a detergent supply device of a washing machine in accordance with another embodiment of the present disclosure, FIG. 9 is a cross-sectional view of the detergent supply device of the washing machine of FIG. 8, and FIG. 10 is a perspective view illustrating a liquid detergent case of the washing machine of FIG. 8.

Hereinafter, with reference to FIGS. 8 to 10, a detergent supply device 21 and a liquid detergent case 200 provided therein in accordance with this embodiment of the present disclosure will be described.

This embodiment differs from the former embodiment shown in FIGS. 3 to 7 in that guide rails 31 are formed on the inner wall of a detergent accommodation space 25 so as to mount the liquid detergent case 200 and thus the liquid detergent case 200 is mounted on the inner wall of the detergent accommodation space 25 if use of a liquid detergent is necessary.

If a user desires to use a powdered detergent, the user puts the powdered detergent into the powdered detergent accommodation space 25, and if a user desires to use a liquid detergent, the user mounts the liquid detergent case 200 within the powdered detergent accommodation space 25 and then pours the liquid detergent into the liquid detergent case 200.

The liquid detergent case 200 includes a box-shaped body part 201 provided with an opened upper surface and a liquid detergent accommodation space 208 formed therein.

The liquid detergent case 200 is provided with a siphon pipe 203 and a siphon cap 204 to generate siphonage, and a remaining water discharge hole 210 to discharge remaining water is formed on a bottom surface 202 of the liquid detergent accommodation space 208.

In the same manner as the former embodiment shown in FIGS. 3 to 7, an opening and closing unit 111 to open and close the remaining water discharge hole 210 is provided.

Further, in order to restrict horizontal movement of the opening and closing unit 111 and thus to maximally transmit force in the vertical direction, a guide part 233 protruded downwardly is formed around the remaining water discharge hole 210 of the bottom surface 202.

As described above, the configuration of the liquid detergent case in accordance with this embodiment has been given. Next, with reference to FIGS. 6 and 7, a process of discharging remaining water from the detergent case 23 in accordance with one embodiment will be described briefly.

Since the opening and closing unit 111 is moved downwardly by gravity prior to pouring of a liquid detergent into the detergent case 23, the remaining water discharge hole 110 is in an opened state. When the liquid detergent is poured into the detergent case 23, a small amount of the liquid detergent may be discharged to the outside of the detergent case 23 through the remaining water discharge hole 110 at an initial stage. Therefore, the amount of the liquid detergent discharged to the outside at the initial stage may be reduced by designing the detergent case 23 such that a cross-sectional area of the detergent case 23 is small so as to enable a water level in the detergent case 23 to rapidly increase.

As shown in FIG. 6, when the liquid detergent or wash water is continuously poured into the detergent case 23, the buoyancy member 120 is raised due to buoyancy and the sealing member 130 seals the remaining water discharge hole 110.

When the liquid detergent or the wash water is more poured into the detergent case 23 and thus siphonage is generated, the wash water is discharged to the outside of the detergent case 23 through the siphon channel 107, sequentially passes through the outlet 32 of the housing 22 and the connection pipe 17, and is then supplied to the inside of the tub 11.

When the wash water accommodated within the detergent case 23 is discharged to the outside using siphonage and thus the water level in the detergent case 23 decreases, as shown in FIG. 7, the buoyancy member 120 moves downwardly, and the sealing part 132 of the sealing member 130 is separated from the bottom surface 102 and thus the remaining water discharge hole 110 is opened. Therefore, even if siphonage is stopped due to decrease in the water level, the wash water is completely discharged to the outside through the remaining water discharge hole 110.

As is apparent from the above description, a detergent case in accordance with one embodiment of the present disclosure prevents wash water from remaining therein. Therefore, the detergent case may be kept clean.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A detergent case comprising:

a liquid detergent accommodation space;

a siphon pipe protruded upwardly from a bottom surface of the liquid detergent accommodation space so as to discharge a liquid, which is accommodated within the liquid detergent accommodation space, to an outside of the liquid detergent accommodation space if the liquid reaches a designated height;

a siphon cap surrounding the siphon pipe so as to form a siphon channel;

a remaining water discharge hole formed on the bottom surface of the liquid detergent accommodation space so as to discharge a remainder of the liquid, not discharged by the siphon pipe, to the outside of the liquid detergent accommodation space; and an opening and closing unit moving upwardly and downwardly due to buoyancy of the liquid accommodated within the liquid detergent accommodation space to open and close the remaining water discharge hole, wherein the opening and closing unit includes: a buoyancy member and a sealing member located beneath the buoyancy member, and the sealing member is connected to a lower end of the buoyancy member, and wherein the buoyancy member is floated due to the buoyancy of the liquid accommodated within the liquid detergent accommodation space and the sealing member seals the remaining water discharge hole.

2. The detergent case according to claim 1, wherein the opening and closing unit includes:

the sealing member, which is located beneath the buoyancy member and connected to the lower end of the buoyancy member, to open and close the remaining water discharge hole to allow the liquid to flow to the outside of the liquid detergent accommodation space and then flow through a connection pipe.

3. The detergent case according to claim 1, wherein the bottom surface of the liquid detergent accommodation space is inclined such that the remaining water discharge hole is formed at a lowermost position of the liquid detergent accommodation space.

4. The detergent case according to claim 2, wherein the buoyancy member includes:

a head part having an upwardly concave shape, an extension part extended from a lower end of the head part and passing through the remaining water discharge hole, and a plurality of legs separated from each other so as to prevent the head part from being closely adhered to the bottom surface of the liquid detergent accommodation space; and the sealing member is connected to a lower end of the extension part.

5. The detergent case according to claim 4, wherein a cavity is formed within the head part.

6. The detergent case according to claim 4, wherein a groove into which the sealing member is inserted is formed on the outer circumferential surface of the extension part.

7. The detergent case according to claim 2, wherein the buoyancy member is formed of polypropylene.

8. The detergent case according to claim 4, wherein the sealing member includes a connection part closely adhered to the extension part and a sealing part inclinedly extended upwardly from the edge of the connection part to seal the remaining water discharge hole.

9. The detergent case according to claim 8, wherein the sealing part of the sealing member is formed of rubber.

10. The detergent case according to claim 1, further comprising a guide part protruded downwardly around the remaining water discharge hole so as to restrict horizontal movement of the opening and closing unit to maximally transmit force in the vertical direction.

11. A detergent case comprising:

at least one liquid detergent accommodation space;

a first discharge hole formed in one of the at least one liquid detergent accommodation space to generate siphonage so as to discharge a liquid accommodated therewithin if the liquid reaches a designated height; and a second discharge hole passing through a bottom surface of the liquid detergent accommodation space provided with the first discharge hole so as to discharge a remainder of the liquid not discharged through the first discharge hole, and the second discharge hole is separated from the first discharge hole, an opening and closing unit moving upwardly and downwardly due to buoyancy of the liquid accommodated within the liquid detergent accommodation space to open and close the second discharge hole, wherein the opening and closing unit includes: a buoyancy member and a sealing member located beneath the buoyancy member, and the sealing member is connected to a lower end of the buoyancy member, and wherein the buoyancy member is floated due to the buoyancy of the liquid accommodated within the liquid detergent accommodation space and the sealing member seals the remaining water discharge hole.

12. A washing machine having a detergent supply device installed at one side of a main body, the detergent supply device comprising a detergent case having a liquid detergent accommodation space, wherein the detergent case includes:

a siphon pipe to generate siphonage so as to discharge a liquid if the liquid reaches a designated height;

a remaining water discharge hole to discharge a remainder of the liquid not discharged by the siphon pipe; and an opening and closing unit moving upwardly and downwardly due to buoyancy of the liquid accommodated within the liquid detergent accommodation space to open and close the remaining water discharge hole, wherein the opening and closing unit includes: a buoyancy member and a sealing member located beneath the buoyancy member, and the sealing member is connected to a lower end of the buoyancy member, and wherein the buoyancy member is floated due to the buoyancy of the liquid accommodated within the liquid detergent accommodation space and the sealing member seals the remaining water discharge hole.

13. The washing machine according to claim 12, wherein the opening and closing unit includes the sealing member connected to a lower end of the buoyancy member to open and close the remaining water discharge hole.

14. The washing machine according to claim 12, wherein the remaining water discharge hole is formed at a lowermost position of the liquid detergent accommodation space.

15. The washing machine according to claim 13, wherein the buoyancy member includes:

a head part having an upwardly concave shape, an extension part extended from a lower end of the head part and vertically passing through the remaining water discharge hole, and a plurality of legs separated from each other so as to prevent the head part from being closely adhered to the bottom surface of the liquid detergent accommodation space; and the sealing member is connected to a lower end of the extension part.

16. The washing machine according to claim 15, wherein the sealing member includes a connection part closely adhered to the extension part and a sealing part inclinedly extended upwardly from the edge of the connection part to seal the remaining water discharge hole.

17. The washing machine according to claim 12, wherein the detergent case further includes a guide part protruded downwardly around the remaining water discharge hole so as to restrict horizontal movement of the opening and closing unit to translate a force of the buoyancy member in a vertical direction.

18. The washing machine according to claim 12, further comprising:

a liquid detergent case detachably mounted in the liquid detergent accommodation space;

guide rails formed on an inner wall of the liquid detergent accommodation space to mount the liquid detergent case thereon.

19. The washing machine according to claim 18, wherein the liquid detergent case includes a box-shaped body part provided with an opened upper surface and a liquid detergent accommodation space formed therein.

20. The washing machine according to claim 19, wherein the siphon pipe, the remaining water discharge hole and the opening and closing unit are formed in the liquid detergent case.

21. The detergent case according to claim 1, wherein if the opening and closing unit is fully lowered, then the remaining water discharge hole is opened to allow the liquid to flow to the outside the liquid detergent accommodation space, and wherein if the opening and closing unit is fully raised, the remaining water discharge hole is closed and prevents the liquid from flowing to the outside the liquid detergent accommodation space.

* * * * *